US007543390B2

(12) United States Patent
Bach

(10) Patent No.: US 7,543,390 B2
(45) Date of Patent: Jun. 9, 2009

(54) ARCHERY PEEP SIGHT

(76) Inventor: Jon Carl Bach, 9 S. Washington St., Frenchtown, NJ (US) 08825

( * ) Notice: Subject to any disclaimer, the term of this patent is extended or adjusted under 35 U.S.C. 154(b) by 0 days.

(21) Appl. No.: 12/215,280

(22) Filed: Jun. 26, 2008

(65) Prior Publication Data

US 2009/0007445 A1 Jan. 8, 2009

Related U.S. Application Data

(60) Provisional application No. 60/947,773, filed on Jul. 3, 2007.

(51) Int. Cl.
*F41G 1/467* (2006.01)

(52) U.S. Cl. ..... 33/265; 124/87

(58) Field of Classification Search ..... 33/265; 124/87, 90, 88

See application file for complete search history.

(56) References Cited

U.S. PATENT DOCUMENTS

| | | | | |
|---|---|---|---|---|
| 295,252 | A | 3/1884 | Hutchins | |
| 3,410,644 | A | 11/1968 | McLendon | |
| 3,703,771 | A | 11/1972 | Saunders | |
| 4,656,747 | A | 4/1987 | Troncoso | |
| 4,965,938 | A | 10/1990 | Saunders | |
| 5,379,747 | A * | 1/1995 | Morris et al. | 124/87 |
| 5,542,186 | A | 8/1996 | Saunders | |
| 5,669,146 | A | 9/1997 | Beutler | |
| 5,715,805 | A | 2/1998 | Summers et al. | |
| 5,860,408 | A | 1/1999 | Summers | |
| 5,996,569 | A | 12/1999 | Wilson | |
| 6,131,295 | A | 10/2000 | Cranston | |
| 6,282,800 | B1 * | 9/2001 | Beutler | 33/265 |
| 6,860,021 | B1 * | 3/2005 | Connelly, III | 33/265 |

* cited by examiner

*Primary Examiner*—Yaritza Guadalupe-McCall
(74) *Attorney, Agent, or Firm*—John F. Letchford; Archer & Greiner, P.C.

(57) ABSTRACT

An archery peep sight including first and second, non-interlocking housing members that fully enclose and clampingly engage separated strands of a bowstring, thereby avoiding the need for serving. The sight is formed of high-strength, lightweight material, is generally elliptical in shape and interiorly captures two separated strands of a bowstring along its opposed longitudinal sides. By fully enclosing the bowstring strands, the sight resists ingress of moisture, debris other undesirable matter that might hinder operation of the sight or deteriorate the bowstring at the sight location. In addition, the non-interlocking nature of the first and second housing members permits them to be easily and non-destructively removed from a bowstring whenever desired or necessary.

6 Claims, 5 Drawing Sheets

ARCHERY PEEP SIGHT

CROSS REFERENCE TO RELATED APPLICATION

This application claims the benefit of U.S. Provisional Application No. 60/947,773, filed Jul. 3, 2007.

FIELD OF THE INVENTION

The present invention relates in general to archery equipment and in particular to a peep sight carried by the bowstring of an archery bow.

BACKGROUND OF THE INVENTION

In the field of archery, it is conventional practice to mount a peep sight on a bowstring of an archery bow. A peep sight is an optical sighting device having a sight opening that an archer aligns with the front sight of the bow to focus on a desired object or target.

In a typical archery peep sight arrangement, the peep sight is secured at a desired location along the bowstring by serving or string (which, for best results, is tied to the bowstring by an archery equipment professional). A rubber or silicone elastomeric tube may connect the peep sight to the bow cable of an archery bow. Upon full draw, tension in the elastomeric tube between the peep sight and the bow cable maintains the peep sight opening in alignment with the front bow sight.

Examples of serving-mounted peep sights are disclosed in U.S. Pat. Nos. 3,410,644; 5,542,186 and 6,131,295. A disadvantage of serving-mounted peep sights is that, regardless of how well the serving may be tied, the act of pulling the bowstring back to full draw tends to cause the peep sight to move upwardly along the bowstring. As a consequence, the peep sight does not retain its desired position and the archer's shooting accuracy is correspondingly compromised.

Clamping means have been proposed as an alternative to serving for securing peep sights to bowstrings. Examples include the two-part peep sights disclosed in U.S. Pat. Nos. 4,656,747 and 5,680,480. In U.S. Pat. No. 4,656,747 the peep sight is clamped between separated strands of a bowstring and in U.S. Pat. No. 5,680,480 the bowstring remains unseparated but is clamped between a pair of peep sight sections. If installed properly, such devices should be able to fix the peep sight at a desired position on the bowstring. In the device described in U.S. Pat. No. 4,656,747, the bowstring strands are exposed to the ambient environment and, therefore, to moisture, debris or other undesirable matter that might hinder operation of the sight or deteriorate the bowstring at the sight location. In the device described in U.S. Pat. No. 5,680,480, the bowstring is clamped within the sight housing. However, the bowstring is essentially permanently clamped within the sight by interlocking projections and recesses provided on the first and second housing sections of the sight. A pin or screw secures the sections together and retains the sight at a desired position along the bowstring. A disadvantage of such a sight is that, because of the mechanical interlock between the housing sections, the sections must be pried apart to remove the sight from the bowstring which may result in damage to either or both of the housing sections.

An advantage exists, therefore, for an archery peep sight which fully encloses and firmly clamps the strands of bowstring. Such sight should be of minimum size and weight, should have high strength and durability, and should be easily and non-destructively attached to and removed from a bowstring.

SUMMARY OF THE INVENTION

The present invention represents a considerable improvement in relation to conventional peep sight arrangements. The present invention is an archery peep sight comprising first and second non-interlocking housing members that fully enclose and clampingly engage separated strands of a bowstring, thereby avoiding the need for serving. The sight is formed of high-strength, lightweight material, is generally elliptical in shape and interiorly captures two separated strands of a bowstring along its opposed longitudinal sides.

The present invention offers several significant advantages in relation to presently available peep sight assemblies. One, it is easily and firmly clampable to the bowstring using a simple tool such as a screwdriver. Two, it does not require the use of serving or string to secure the peep sight to the bow string. Thus, it does not require the services of an archery equipment professional to perform the requisite serving tying (which, as noted above, does not assure the desired position of the peep sight no matter how well the serving is tied). Three, because the fasteners tightly clamp the peep sight to the bowstring, movement of the peep sight is eliminated and the archer's accuracy is correspondingly enhanced. Four, because the bowstring is fully enclosed within channels provided in the peep sight, the bowstring, at least in the region of the sight, is protected from the ambient environment. Five, the peep sight may be made of high-strength, yet lightweight and comparatively inexpensive materials such that the sight may be offered for retail sale either in single units or in a kit of multiple sights at reasonable cost to the end consumer.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 9:
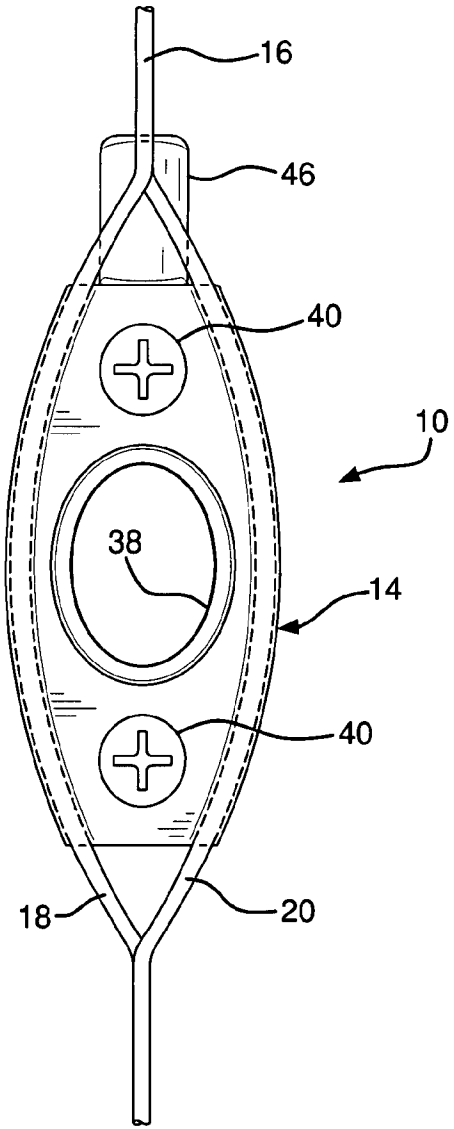
FIG. 9 is a view of a peep sight constructed according to the present invention as it would appear when assembled and attached to a bowstring of an archery bow.

Referring to the drawings wherein like or similar references indicate like or similar elements throughout the several views, there is shown in FIG. 9 a peep sight according to the present invention, identified generally by reference numeral 10. Peep sight 10 preferably comprises first and second cooperating housing members 12 and 14, described below in connection with other drawing figures, which may be made of any suitable high-strength, lightweight material such as, for example, plastic, metal or metal alloy. A presently preferred material is glass fiber reinforced nylon as it provides high strength at comparatively lower materials and fabrication costs versus other materials such as metals or metal alloys.

Sight 10 is desirably generally elliptical in shape and interiorly captures two separated strands of a bowstring along its opposed longitudinal sides, which bowstring and strands are shown in line in FIG. 9 and represented by reference numerals 16, 18 and 20, respectively. For reference purposes only, housing member 12 may be viewed as a "base" member and housing member 14 a "cover" member of the peep sight 10 according to the invention. It will be understood, however, that the internal structures of members 12 and 14 may configured in any fashion so long as they adhere to the spirit and scope of the present invention as disclosed herein.

As seen in FIGS. 1 through 6, housing member 12 includes a foundation 22 atop which is formed a protruding central portion 24. The longitudinal edges or sides of central portion 24 define a first pair of races or grooves 26 and 28. As described in greater detail below, grooves 26, 28 cooperate with corresponding grooves provided in housing member 14 to form channels for enclosing the strands 18, 20 of bowstring 16 when peep sight 10 is attached thereto. Central portion 24 includes a sight hole 30 centered along a vertical line defined by the bowstring and by the longitudinal axis of the peep sight in the manner well known in the art to focus on a desired object or target. Sight hole 30 is preferably somewhat elongated in shape. So shaped, when the bowstring is drawn at an angle to vertical, the elongated sight hole 30 will appear as a round hole to the archer.

Figure 2:
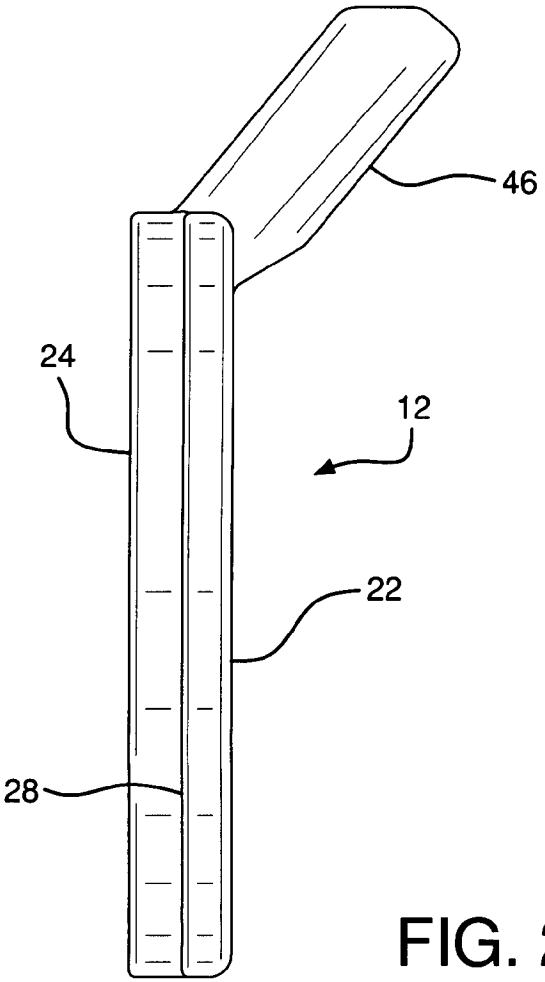
FIG. 2 is a side elevation view of the first housing member of FIG. 1.
Figure 1:
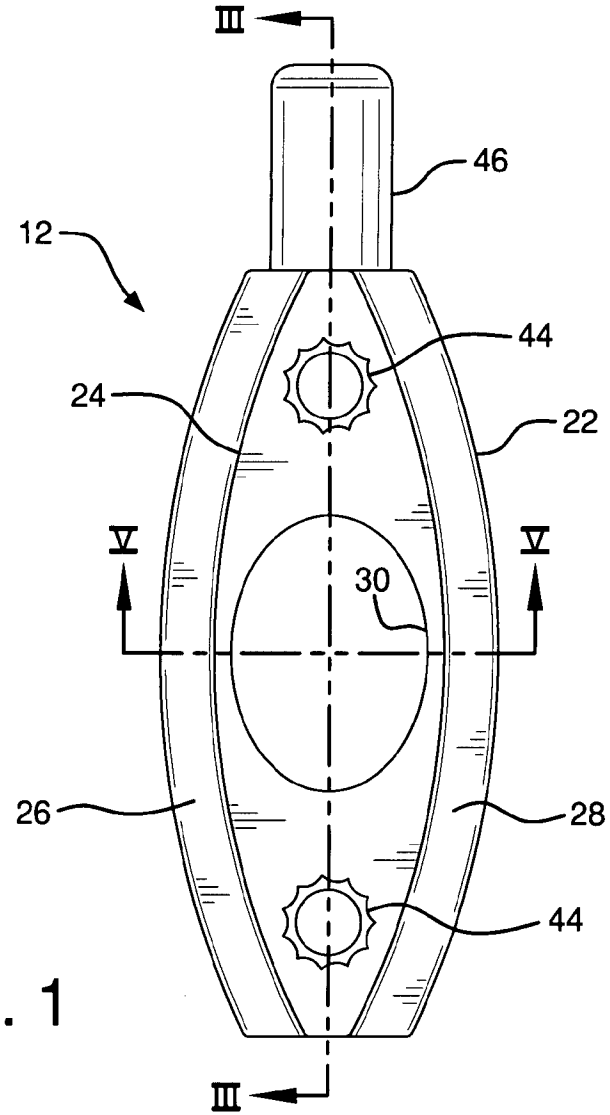
FIG. 1 is an internal plan view of a first housing member of an archery peep sight constructed according to the present invention.
Figure 4:
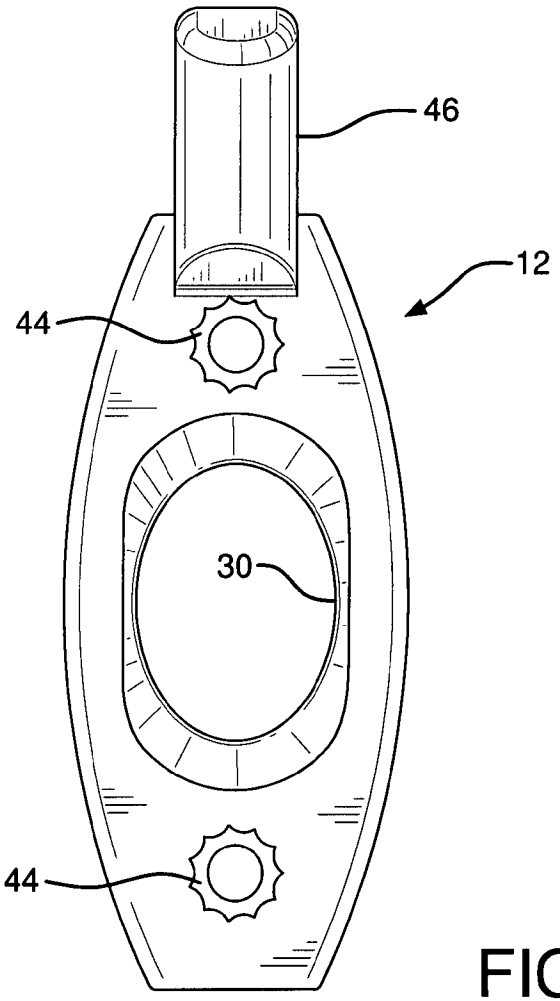
FIG. 4 is an external plan view of a first housing member of FIG. 1.
Figure 3:
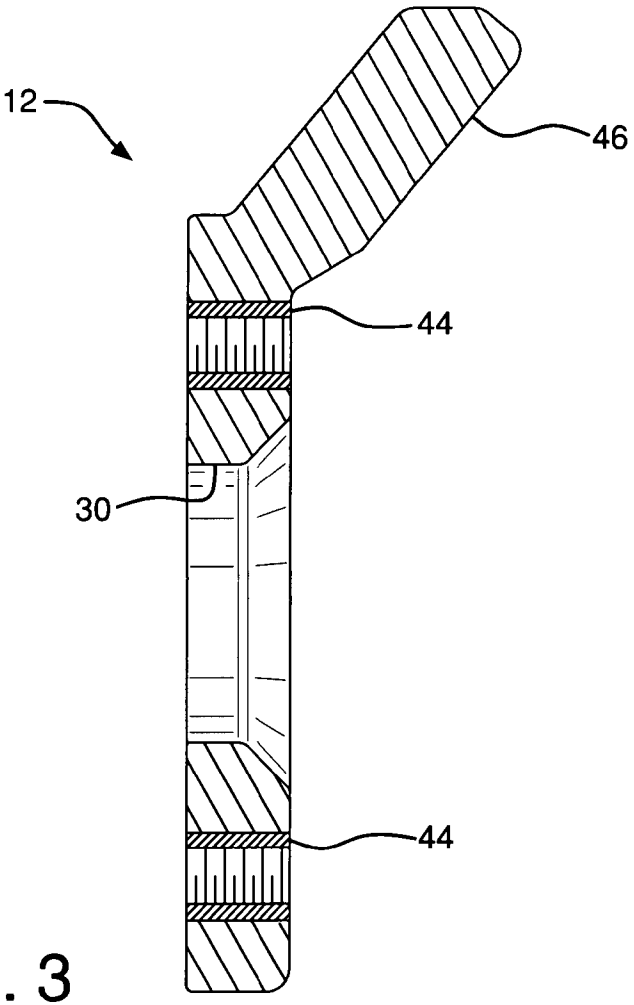
FIG. 3 is a cross-section view of the first housing member of FIG. 1 taken along line III-III thereof.
Figure 6:
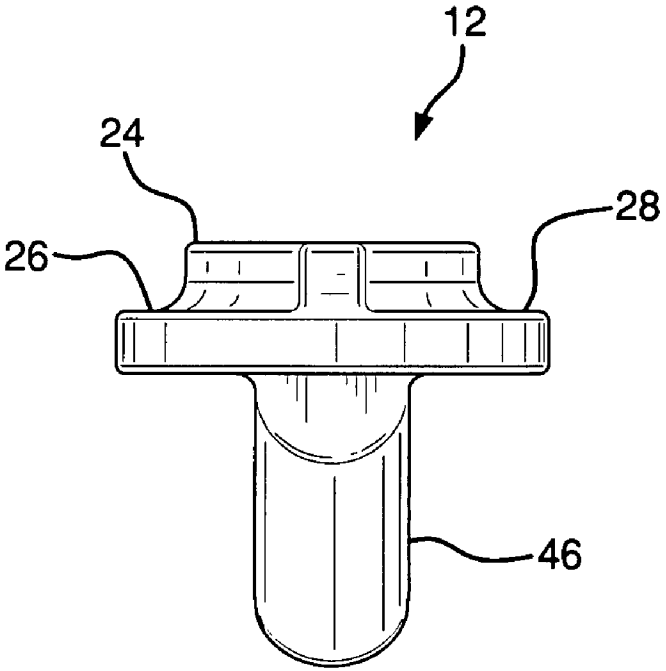
FIG. 6 is an end elevation view of the first housing member of FIG. 1.
Figure 5:
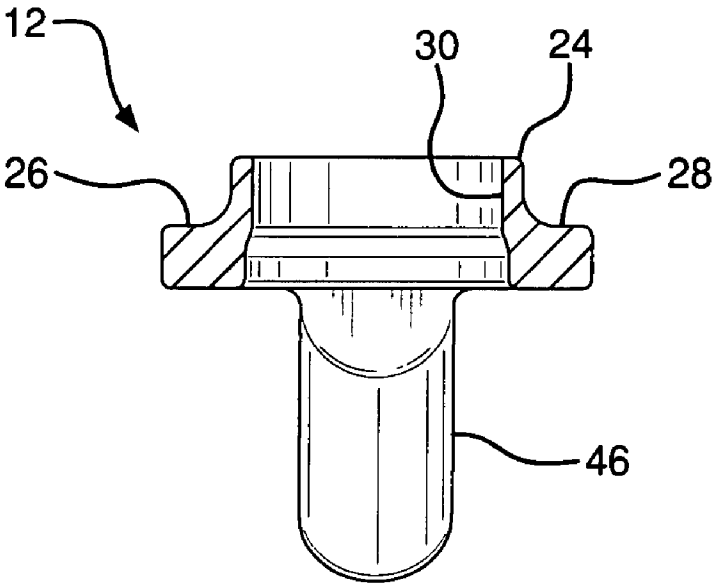
FIG. 5 is a cross-section view of the first housing member of FIG. 1 taken along line V-V thereof.
Figure 8:
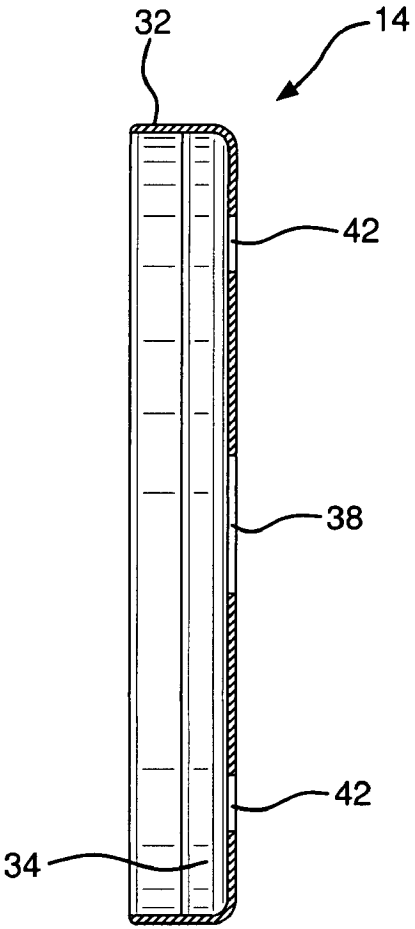
FIG. 8 is a cross-section view of the second housing member of FIG. 7 taken along line VIII-VIII thereof.
Figure 7:
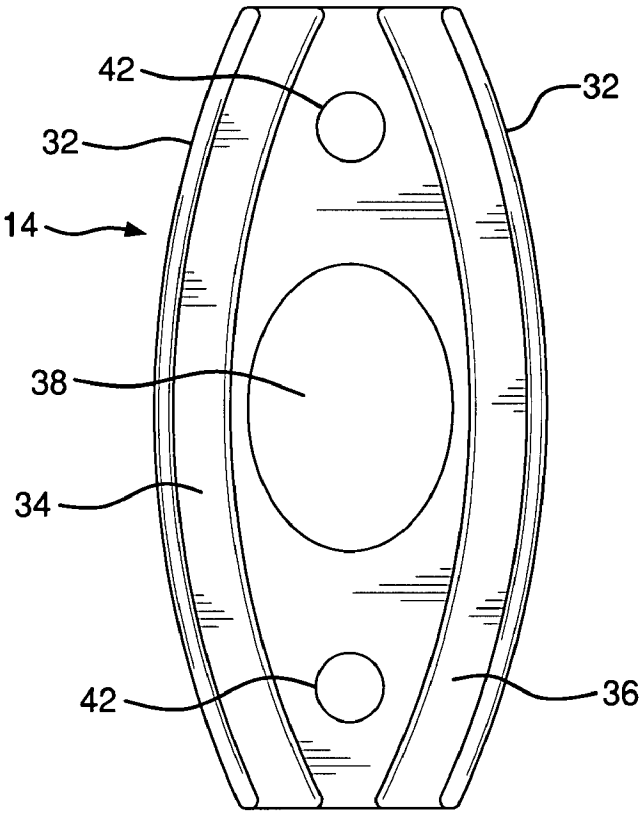
FIG. 7 is an internal plan view of a second housing member of an archery peep sight constructed according to the present invention.
Figure 10:
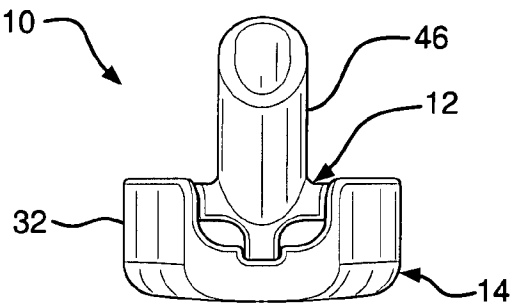
FIG. 10 an end elevation view of a peep sight constructed according to the present invention as it would appear when assembled.

FIGS. 9 and 10 show that housing member 14 is generally constructed as a cover that cooperates with housing member 12 to define an assembly that clampingly receives strands 18, 20 of a bowstring. In this regard, and referring to FIGS. 7, 8 and 10, housing member 14 is preferably dimensioned to closely accommodate housing member 12 in order to resist ingress of moisture, debris other undesirable matter that might hinder operation of the sight or deteriorate the bowstring at the sight location. Housing member 14 includes opposed longitudinal side walls 32 preferably having sufficient height to essentially enclose housing member 12 in the manner shown in FIG. 10. The interior of housing member 14 is formed with a second pair of races or grooves 34 and 36 which, as noted above, cooperate with the first pair of races or grooves 26 and 28 to form channels for enclosing the strands of a bowstring when peep sight 10 is attached thereto. Preferably, grooves 26, 28, 34 and 36 are semicircular in cross-section to permit ease of sliding of the sight along the bowstring; however, they may assume any cross-sectional shape. In addition, second housing member 14 has a sight hole 38 which is also preferably elongate and which is adapted for alignment with, but which may vary in size with respect to, sight hole 30 of housing member 12.

As shown in FIG. 9, a presently preferred means for releasably securing peep sight 10 to a bowstring are screws 40 which are sized to pass through fastener apertures 42 in housing member 14 (FIGS. 7 and 8) and into housing member 12. Such screws may be used to clamp peep sight 10 to a bowstring along with unillustrated nuts. However, as separate nuts may require the use of additional tools for assembly it is not expedient to use separate nuts to clamp the sight to the bowstring. An alternative would be to permanently mount nuts to housing member 12. However, for economy of space, weight and cost, it is most preferable that housing member 12 include internally threaded means 44 (FIGS. 1, 3 and 4) for receiving screws 40. Threaded means 44 desirably include a pair of internally threaded means disposed at opposite ends of sight hole 30. In the event the housing members 12, 14 are formed from metal or metal alloy, threaded means 44 would simply consist of female threading provided in member 12. If, however, the housing members (particularly housing member 12) are formed from plastic, it is recommended that housing member 12 be fitted with internally threaded metallic screw receiving means 44 for receiving screws 40. Without such means, screws 40 would likely quickly become dislodged from housing member 12. In a presently preferred embodiment, screw receiving means 44 comprise externally splined, internally threaded, bushing-like anchors that are embedded in housing member 12 during the peep sight molding or other fabrication process.

To mount peep sight 10 to a bowstring, one would first separate a bowstring into strands of approximately equal diameter to form a generally oval-shaped opening of sufficient size to receive the central portion 24 of housing member 12. The central portion 24 is then inserted into the opening formed by the separated bowstring strands until the separated strands come to rest in the grooves 26 and 28. Thereafter, housing member 14 is placed atop and slid over housing member 12 until the grooves 34 and 36 of housing member 14 receive the separated strands. Lastly, the housing members 12 and 14 are secured together by inserting and securing the screws 40 into the assembly. Adjustment of the position of the sight along the bowstring may be easily achieved by slightly loosening screws 40, sliding the sight to the desired location and retightening the screws. Moreover, it will be appreciated that, because of the non-interlocking relationship of first and second housing members 12 and 14, the housing members may be easily and non-destructively removed from a bowstring whenever desired or necessary.

Either of housing members 12 or 14 (in the illustrated embodiment, housing member 12) may further include an optional alignment arm or post 46 projecting from an end thereof. As is conventional, alignment arm or post 46 may extend at an acute angle with respect to its associated housing member.

As is known, an unillustrated rubber or silicone elastomeric tube having an inside diameter slightly smaller than the outside diameter of the alignment post 46 may be used to connect the peep sight to the bow itself. More specifically, post 46 is insertable into one end of the elastomeric tube, whereby the tube and peep sight 10 are frictionally coupled together, and the other end of the tube is connected to the bow. Upon full draw, tension in the elastomeric tube between the peep sight and the bow maintains the peep sight opening (defined by sight holes 30 and 38) in alignment with the front bow sight.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. An archery peep sight comprising:

a first housing member including first means for receiving separated strands of a bowstring;

a second housing member substantially enclosing said first housing member, said second housing member including second means for receiving separated strands of a bowstring, said first and second means for receiving separated strands of a bowstring forming channels for essentially enclosing separated strands of a bowstring; and means for releasably securing said first housing member to said second housing member.

2. The archery peep sight of claim 1 wherein said first means for receiving separated strands of a bowstring comprise first grooves provided in said first housing member and said second means for receiving separated strands of a bowstring comprise second grooves provided in said second housing member, wherein said grooves correspond and cooperate with said grooves to form said channels for enclosing separated strands of a bowstring.

3. The archery peep sight of claim 1 wherein said first and second housing members are non-interlocking.

4. The archery peep sight of claim 1 further comprising a post for aligning said sight with a sight provided on an archery bow.

5. An archery peep sight comprising:

a first housing member including first means for receiving separated strands of a bowstring;

a second housing member substantially enclosing said first housing member, said second housing member including second means for receiving separated strands of a bowstring; and means for securing said first housing member to said second housing member, wherein at least one of said first and second housing members is fabricated from plastic, and wherein said means for securing comprise internally threaded metallic screw receiving anchors embedded in said plastic and screws for threadedly engaging said anchors.

6. The archery peep sight of claim 5 wherein said anchors are externally splined.

* * * * *

UNITED STATES PATENT AND TRADEMARK OFFICE

CERTIFICATE OF CORRECTION

PATENT NO. : 7,543,390 B2
APPLICATION NO. : 12/215280
DATED : June 9, 2009
INVENTOR(S) : Jon Carl Bach It is certified that error appears in the above-identified patent and that said Letters Patent is hereby corrected as shown below:

At claim 2, col. 5, line 20, before "grooves" insert -- first --.

At claim 2, col. 5, line 21, before "grooves" insert -- second --.

Signed and Sealed this

Eleventh Day of August, 2009

David J. Kappos

David J. Kappos
*Director of the United States Patent and Trademark Office*